US006231455B1

(12) United States Patent
Chang

(10) Patent No.: US 6,231,455 B1
(45) Date of Patent: May 15, 2001

(54) GOLF WOOD-CLUB HEAD

(76) Inventor: Prins Shihkun Chang, 234 S. First Ave., Arcadia, CA (US) 91006

( * ) Notice: Subject to any disclaimer, the term of this patent is extended or adjusted under 35 U.S.C. 154(b) by 0 days.

(21) Appl. No.: 09/251,764

(22) Filed: Feb. 17, 1999

(51) Int. Cl.[7] ..... A63B 53/06
(52) U.S. Cl. ..... 473/314; 473/324; 473/332
(58) Field of Search ..... 473/324–349, 473/308, 314

(56) References Cited

U.S. PATENT DOCUMENTS 1,553,867 * 9/1925 Maas .
2,470,406 * 5/1949 Matzie .
3,980,301 * 9/1976 Smith .
4,432,549 * 2/1984 Zebelean .
4,516,778 * 5/1985 Cleveland .
5,009,423 * 4/1991 Okumoto .
5,184,819 * 2/1993 Desbiolles .
5,197,733 * 3/1993 Schroder .
5,505,447 * 4/1996 Mockovak .
5,626,528 * 5/1997 Toulon .
5,647,807 * 7/1997 Nagamoto .
5,762,567 * 6/1998 Antonious .
5,772,526 * 6/1998 Hano .

* cited by examiner

*Primary Examiner*—Jeanette Chapman
*Assistant Examiner*—Stephen L Blau
(74) *Attorney, Agent, or Firm*—Raymond Y Chan; David & Raymond Patent Group

(57) ABSTRACT

A golf wood-club head includes a rear shell member, a face member inclinedly affixed in front of the rear shell member, a hosel, and a L-shaped connecting stem. The L-shaped connecting stem has a head connecting member horizontally and integrally extended from a side of the rear shell member, and a shaft connecting member inclinedly and upwardly extended from the head connecting member for combining together with the hosel. A ring groove is provided around the head connecting member, and a shock absorbing ring is situated around the ring groove for absorbing vibration transferring from the club head. Therefore, the golf wood-club head can increase the horizontal distance between the golf head and the player's hand without changing the lie angle of the wood-club head and the vertical distance between the golf head and the player's hand.

4 Claims, 3 Drawing Sheets

GOLF WOOD-CLUB HEAD

FIELD OF THE PRESENT INVENTION

The present invention relates to golf club, and more particularly to a golf wood-club head that enables the user to slightly adjust the loft and lie angles to fit his or her personal height, and reduces the impacting vibration transferring to the golf shaft.

BACKGROUND OF THE PRESENT INVENTION

Irons and woods are two major kinds of golf club. Generally speaking, irons are designed for accuracy and woods can create distance. Nowadays, although the modern "wood-club" is substantially made of metal or alloy instead of wood, it is still traditionally called wood-club.

Hollow metallic golf club wood heads are well known in arts as disclosed in U.S. Pat. Nos. 5,429,357, 5,460,371, and 5,485,998. The conventional hollow metallic golf club head 10 of the so-called "wood" head type, as shown in FIG. 1, comprises a planar face member 11, a rear shell member 12 having a connecting tube 121 integrally, upwardly and inclinedly extended from a side thereof for combining together with a hosel 13. The rear shell member 12 contributes the major weight of the club head 10 for providing a steady swing. The inclined angle between the connecting tube 121 and the rear shell member 12 determined the lie angle of the club head. The face member 11 is the most important element of the club head 10 because it is the substantial part hitting the golf ball. The loft angle of the face member 11 determines the height and distance of the golf ball to be driven. The face member 11 also forms the impact plane that should be aligned in predetermined angle with the golf shaft 14.

Driver and the fairway woods including such as 3-wood, 5-wood and 7-wood, each having a different loft angle and different shaft length, are the most common wood clubs in your golf bag. In 1915, Alex Smith won the Metropolitan Open, then a very important event, with a driver 48 inches long. Power comes from the length of the club shaft and the hitting force. Therefore, the longer of the club shaft and the smaller of the loft angle of a wood club can hit the golf ball farther for more distance.

As mentioned above, the longer the club shaft, generally enables the wood-club head to hit a ball farther. However, it is nearly impossible to have two persons having exactly the same height and the length of bands and legs. In other words, the body structure of everybody is different but all of them have to adopt the limited manufacturing sizes and shapes of the wood club. Practically, the length of a club shaft must match the distance between the user's hands and the ground. A shorter golf player such as Asian should uses a shorter club shaft in order to provide a perfect lie angle and generate a natural and solid swing but also limiting the distance.

As shown in FIG. 5A, when a golf player having a specific height and arm length sets a wood-club with matching shaft length, the club head should be naturally lie on ground corresponding to the constant lie angle of the golf club. If another wood-club having just one inch longer shaft length is used (as illustrated in dotted lines in FIG. 5A), the club head is then unable to be addressed at the correct lie angle without changing the natural setting of the player. In other words, if a shorter golf player would like to use a longer club to create more distance, he or she must absorb the risk of having non-natural swings.

Besides, due to the structure of the conventional wood-club head as shown in FIGS. 1 and 5A, the loft angle and lie angle of the club head 10 are constant and unadjustable, so that the different users must adjust their bodies, settings and swings to adapt the particular club head 10.

Moreover, the vibration and shock produced when the club head hits the golf ball will partially be absorbed by the club head and mainly be transferred to the golf shaft and be absorbed by the player's hands, arms and shoulders. That is why the manufacturers recently implant foaming material inside the golf shaft for helping to absorb some of shock and vibration. In fact, in order to minimize the sport injuries to the players, any structure improvement that can reduce the vibration and shock being transferred to the player is good design.

SUMMARY OF THE PRESENT INVENTION

The main object of the present invention is to provide a golf wood-club head that increases the horizontal distance between the golf head and the player's hand without changing the lie angle of the wood-club head and the vertical distance between the golf head and the player's hand.

Another object of the present invention is to provide a golf wood-club head which loft angle and lie angle can slightly be adjusted for better matching the height of the user personally.

Another object of the present invention is to provide a golf wood-club head that provides a vibration reduction means between the wood-club head and the club shaft to absorb the vibration and shock generated during the ball impacting.

Accordingly, in order to accomplish the above objects, the present invention provides a golf wood-club head, which comprises:

a rear shell, a face inclinedly affixed in front of the rear shell, a hosel, a L-shaped connecting stem having a head connecting portion horizontally and integrally extended from a side of the rear shell, and a shaft connecting portion integrally, inclinedly and upwardly extended from the head connecting portion for combining together with the hosel, wherein a ring groove is provided around the head connecting portion, and a shock absorbing ring situated around the ring groove for absorbing vibration transferring from the club head.

DETAILED DESCRIPTION OF THE PREFERRED EMBODIMENT

Figure 1:
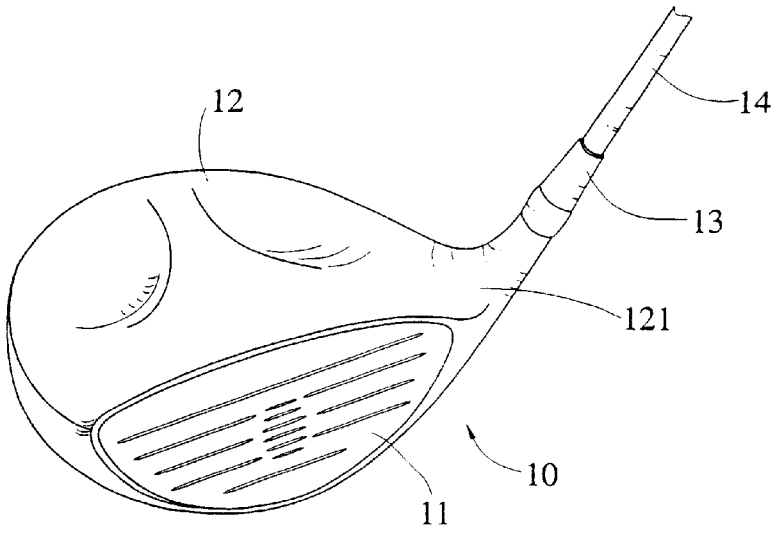
FIG 1 PRIOR ART
FIG. 1 is a perspective view of a conventional golf wood-club head.
Figure 2:
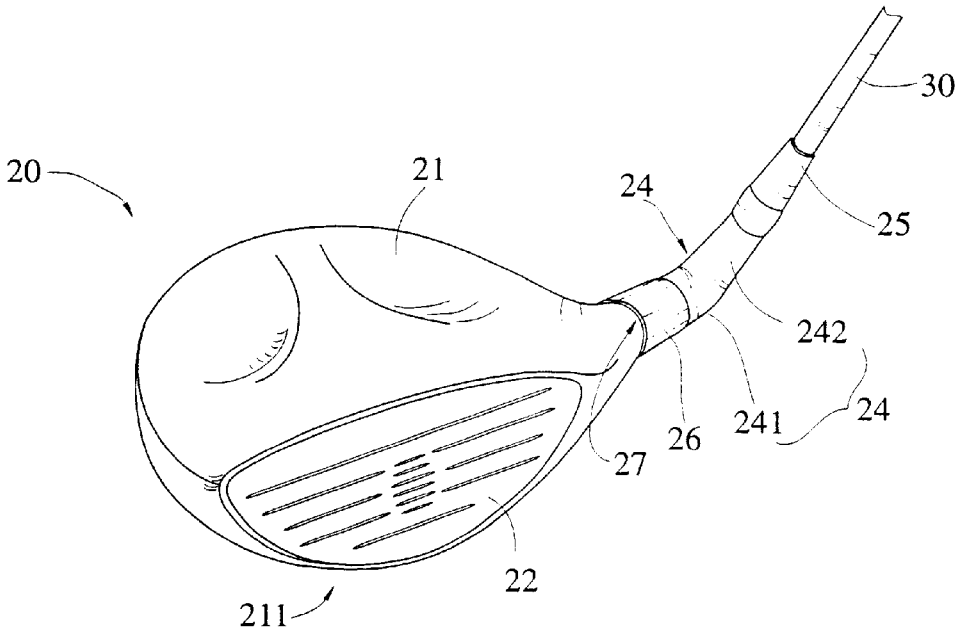
FIG. 2 is a perspective view of a golf wood-club head according to a preferred embodiment of the present invention.
Figure 3:
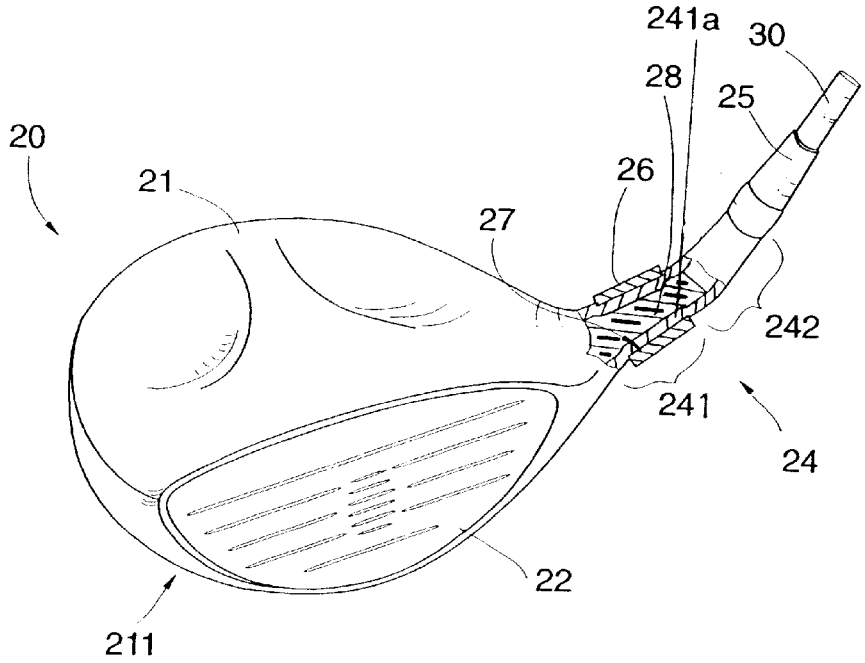
FIG. 3 is a partially sectional view of the golf wood-club head according to the above preferred embodiment.
Figure 4:
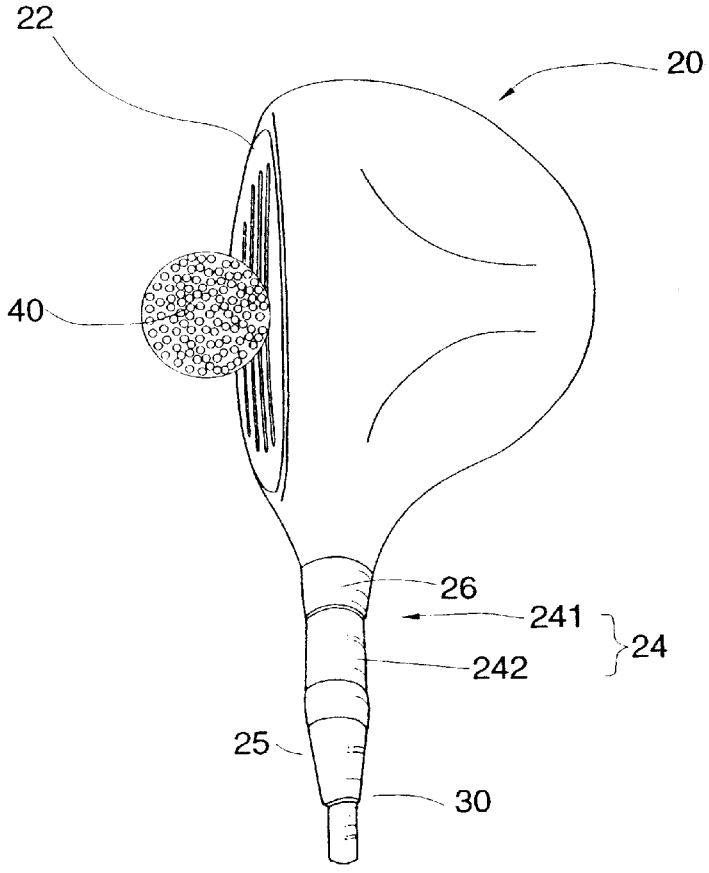
FIG. 4 is a top view of the golf wood-club head while hitting a golf ball according to the above preferred embodiment.

Referring to FIGS. 2 to 4, a golf wood-club head 20 according to a preferred embodiment of the present invention is illustrated, wherein the golf wood-club head 20 comprises a rear shell 21, a face 22 inclinedly affixed in front of the rear shell 21, a L-shaped connecting stem 24 for combining together with a hosel 25, and a shock absorbing ring 26.

As shown in FIGS. 2 and 3, the metallic L-shaped connecting stem 24 having a head connecting portion 241 transversely and integrally extended from a side 211 of the rear shell 21, and a shaft connecting portion 242 integrally, inclinedly and upwardly extended from the head connecting portion 241 for combining together with the hosel 25. The angle between the bottom surface 211 of the rear shell 21 and the shaft connecting portion 242 is the lie angle of wood-club head 20.

A ring groove 27 is provided around a thickened reinforcing portion 241*a* of the head connecting portion 241. The shock absorbing ring 26 made of shock absorbing material such as EVA or rubber fittingly wears around the ring groove 26 for absorbing vibration transferring from the club head 20. Colorful material can be used for the shock absorbing ring 26 so as to provide different colorful appearances for the wood-club head 20 of the present invention. The user may also alter the club's appearance to match his or her personality by changing a specific color of shock absorbing ring 26.

Moreover, a segment of shock absorbing material 28 is also situated inside the hollow head connecting portion 241. Therefore, as shown in FIGS. 3 and 4, the vibration produced during the face 22 hits a golf ball 40 will first transfer to the head connecting portion 241 and then the golf shaft 30 connected to the hosel 25. The shock absorbing ring 26 surrounded the head connecting portion 241 as well as the shock absorbing material 28 inside the head connecting portion 241 would absorb the vibration and shock transferred thereto, so as to reduce the vibration transferring to the shaft connecting portion 242 and the club shaft 30.

Figure 5A:
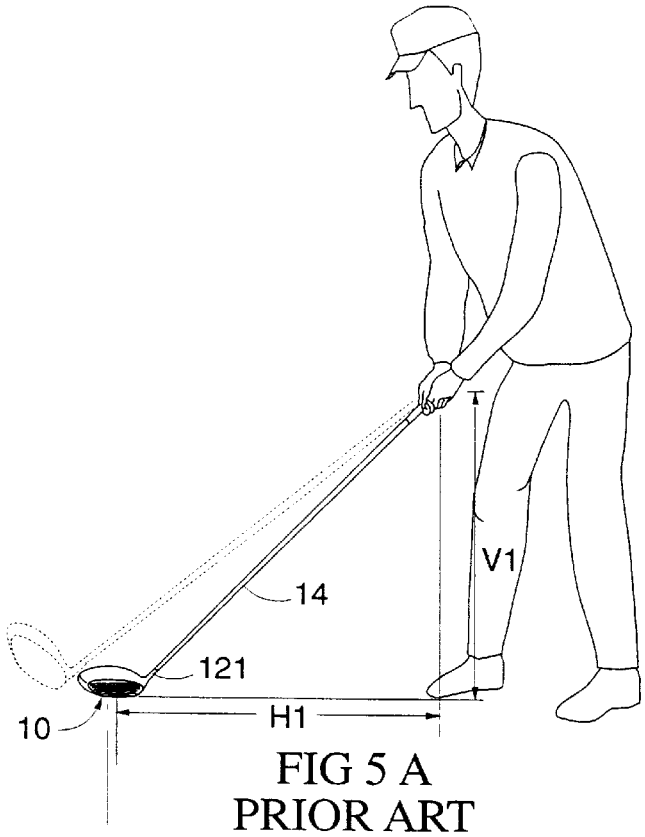
FIG 5 A PRIOR ART
FIG. 5A is a side view of a conventional golf club having the golf wood-club head as shown in FIG. 1 and being setup by a golf player.

FIG. 5A illustrates a golf player setting up with a conventional golf wood-club, wherein the horizontal distance and vertical distance between the player's gripping hands and the center of the conventional club head 10 are H1 and V1 respectively.

Figure 5B:
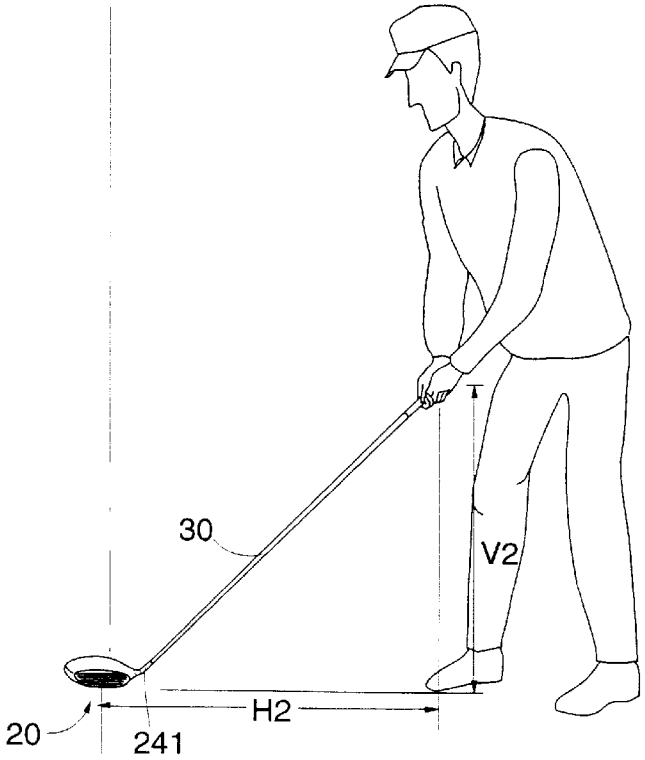
FIG. 5B is a side view of a golf club having the golf wood-club head as shown in FIGS. 2 to 4 and being setup by a golf player.

Referring to FIG. 5B, supposing that the same golf player having a same set-up with a golf wood-club of the present invention, the horizontal distance and the vertical distance between the player's gripping hands and the center of the wood-club head 20 are H2 and V2. However, H2 is longer than H1 for the length of the head connecting member 241 while the V1 remains equal to V2. Therefore, the player can produce more power at the wood-club head 20 with a longer horizontal distance H2 without changing the natural lie angle of the wood-club head 20.

For players with different heights and arm lengths, each player may bend and/or twist the head connecting portion 241 with respect to the shaft connecting portion 242 of the connecting stem 24 by a bending machine so as to adjust the loft angle of the face 22 and the lie angle of the wood-club head 20 for personally adapting the player's body and setting up.

In view of above, the present invention can substantially achieve the following features:

1. It can increase the horizontal distance between the golf head and the player's hand without changing the lie angle of the wood-club head and the vertical distance between the golf head and the player's hand.
2. Its loft angle and lie angle can slightly be adjusted for better matching the height and the arm length of the user personally.
3. It provides a vibration reduction means between the wood-club head and the club shaft to absorb the vibration and shock generated during the ball impacting.

What is claimed is:

1. A golf wood-club head, comprising:

a rear shell;

a face inclinedly affixed in front of said rear shell;

a hosel for affixing a golf shaft thereto;

a L-shaped connecting stem, which is extended between said rear shell and said hosel, having a head connecting portion transversely and integrally extended from a side of said rear shell and a shaft connecting portion integrally, inclinedly and upwardly extended from said head connecting portion for combining together with said hosel, wherein said head connecting portion is arranged to extended parallelly with a bottom surface of said rear shell so as to define a lie angle for said golf wood-club head as an angle between said head connecting portion and said shaft connection portion; and a shock absorbing ring fittingly surrounded said head connecting portion for absorbing vibration transferring from said rear shell and said face during impacting;

thereby, said head connecting portion is capable of increasing a horizontal distance between a center of said face and said hosel for affixing said golf shaft while maintaining said lie angle of said golf wood-club head, moreover a loft angle of said face and said lie angle of said golf wood-club head is able to be adjusted by bending said shaft connecting portion with respect to said head connecting portion of said L-shaped connecting stem.

2. The golf wood-club head, as recited in claim 1, wherein a ring groove is provided around a thickened reinforcing portion of said head connecting portion, and said shock absorbing ring made of shock absorbing material fittingly wears around said ring groove.

3. The golf wood-club head, as recited in claim 1, wherein said head connecting portion has a hollow tube structure and a segment of shock absorbing material is fittedly situated inside said head connecting portion.

4. The golf wood-club head, as recited in claim 2, wherein said head connecting portion has a hollow tube structure and a segment of shock absorbing material is fittedly situated inside said head connecting portion.

* * * * *